US007416608B2

(12) United States Patent
Liu et al.

(10) Patent No.: US 7,416,608 B2
(45) Date of Patent: Aug. 26, 2008

(54) PROCESS AND RELATED APPARATUS FOR BLOCK COATING

(75) Inventors: Ta-Jo Liu, Hsinchu (TW); E-Ron Chang, Hsinchu (TW)

(73) Assignee: National Tsing Hua University, Hsinchu (TW)

( * ) Notice: Subject to any disclaimer, the term of this patent is extended or adjusted under 35 U.S.C. 154(b) by 373 days.

(21) Appl. No.: 11/087,550

(22) Filed: Mar. 24, 2005

(65) Prior Publication Data

US 2006/0169205 A1 Aug. 3, 2006

(51) Int. Cl.
*B05C 3/02* (2006.01)

(52) U.S. Cl. ..... 118/411; 118/419; 118/602

(58) Field of Classification Search ..... 118/411, 118/410, 419, 600, 602; 425/146, 145, 141, 425/460, 376.1, 382.3, 464, 133.5, 382 R
See application file for complete search history.

(56) References Cited

U.S. PATENT DOCUMENTS

| | | | | |
|---|---|---|---|---|
| 3,941,902 | A * | 3/1976 | Wennerblom et al. | 427/172 |
| 4,142,010 | A * | 2/1979 | Pipkin et al. | 427/355 |
| 5,334,247 | A * | 8/1994 | Columbus et al. | 118/411 |
| 5,399,196 | A * | 3/1995 | Ichikawa et al. | 118/407 |
| 6,540,833 | B1 * | 4/2003 | Gibson et al. | 118/410 |

* cited by examiner

*Primary Examiner*—Brenda A. Lamb
(74) *Attorney, Agent, or Firm*—Bacon & Thomas PLLC

(57) ABSTRACT

The present invention discloses an apparatus for block type extrusion coating, and a process for forming block coating or grid-type coating on a substrate. The present invention uses a die set composed of an upper mold, a lower mold and a shim therebetween, which can be used to form a plurality of coated stripes. The present invention further uses several control valves, pumps and a controller to intermittently extrude a coating solution from the die set, so that the stripe coating is converted to a block coating. The block coated substrate can be rotated 90 degrees, followed by a stripe coating process to form a grid-type coating on the substrate.

6 Claims, 4 Drawing Sheets

PROCESS AND RELATED APPARATUS FOR BLOCK COATING

REARGROUND OF THE INVENTION

1. Field of the Invention

The present invention relates to an apparatus and process for performing block coating or grid-type coating on a substrate. The present invention can also be used for manufacturing tapes and films with a block or grid-type coating of adhesive and forming block or grid-type coatings on a glass substrate.

2. Description of the Related Art

U.S. Pat. No. 4,106,437 discloses an apparatus for multiple stripe coating of a web with liquid coating composition which is comprised of a hopper having a pair of spaced lips and a pair of shims mounted in face-to-face arrangement within the hopper and positioned between the spaced lips. One of the shims is provided with a plurality of open-ended channels while the second shim is equipped with a plurality of projecting portions, corresponding in width and location to the desired stripes, which are in alignment with the open-ended channels and project beyond the open ends thereof. The apparatus is capable of carrying out multiple stripe coating of a web at high speeds and with a high degree of precision in regard to stripe width and registration.

U.S. Pat. No. 6,159,544 adds a special guide shim into two overlapping molds so that two A, B coating solutions can join in the molds to generate a good quality ABAB stripe coating product. The guide shim can be clipped by the molds but cannot be deformed.

The typical tape for packaging testing has some special requirements, which include heat resistance, low absorptivity, and a quality adhesive. Consequently, it is very expensive; consider, for example, the packaging tape for 64K, or 128K DRAM. Since the tape is expensive, it is necessary to limit usage to reduce costs. During tests for some advanced packaging products, the product's four edges need to be sealed and the middle island is exposed. Taking a product that is the size of a business card as an example, the tape can be cut into four pieces and adhered separately on the four edges; however, this is not a very efficient method, and it is not easy to control quality. Therefore, it is necessary to develop a special tape that has a grid-type adhesive coating to seal the four edges of a test device For LCD manufacturers, block coatings or grid-type coatings sometime are required to be formed on a glass substrate.

A block coating is a non-continuous coating; this technology should be able to coat substrates with large or small areas. However, this technology has dificulties providing a film coating with smooth front and rear edges. U.S. Pat. No. 4,050,410 is the earliest patent concerning the block coating process, which utilizes a pump to cause fluid to flow into a slot die, and which provides a recycling-flow exit to control the flow out of the mold by turning on or off a recycling-flow pump.

U.S. Pat. No. 4,938,994 discloses a controlled volume per unit area of a liquid coating to a discrete, incremental substrate with a premetered liquid layer "patch" that has a four-sided shape and a predetermined coating thickness. A source of liquid is fluidly coupled to a liquid-containing chamber that, in turn, is fluidly coupled to an applicator slot having an applicator slot exit aperture. With the substrate positioned in proximity to the applicator slot exit aperture, the coating "patch" is initiated by producing a positive pulse of liquid that flows out of the applicator slot exit aperture forming a bead of liquid coating and sending a controlled volumetric flow rate of the liquid through the applicator slot. The positive pulse of liquid is produced by suddenly displacing a volume of the liquid in the liquid containing chamber. Once the liquid connecting bead is formed with the substrate, the controlled volumetric flowrate of the liquid issuing from the applicator slot exit aperture, combined with relative movement between the applicator and the substrate, apply the liquid coating to the substrate surface. Termination of the liquid coating bead is achieved with a negative, disconnecting pulse that creates a momentary vacuum in a portion of the liquid containing chamber which sucks the coating liquid up into the applicator slot and breaks the connecting bead of liquid coating between the applicator slot exit aperture and the substrate surface.

U.S. Pat. No. 5,167,837 discloses a block coating technology, which provides an automatically programmed apparatus. The apparatus can provide programmed flow control and programmed substrate movement speeds. Furthermore, the die mold can move toward the substrate at the beginning of the coating process and move away from the substrate at the end of the coating process.

U.S. Pat. No. 5,360,629 discloses an apparatus for coating a pattern of spaced discrete patches on a web of material, and includes an extrusion die and a metering pump that supplies coating fluid to the extrusion die from a fluid reservoir. The advantage of this patent is that, during the block coating process, an air-operated three way valve can control the flow without changing the operation of the pump.

With regards to the previous technologies, U.S. Pat. No. 4,050,410 has problems repeating the same block coating process. U.S. Pat. Nos. 4,938,994 and 5,167,837 relate to the moveable die mold, which limits the coating velocity. U.S. Pat. No. 5,360,629 creates film coating with uneven edges.

Therefore, it is desirable to provide a process and related apparatus for performing block coating or grid-type coating on a substrate to mitigate and/or obviate the aforementioned problems.

SUMMARY OF THE INVENTION

A main objective of the present invention is to provide an apparatus for performing block coating or grid-type coating without the problems previously mentioned.

Another objective of the present invention is to provide a process for performing block coating or grid-type coating on a substrate.

In order to accomplish the aforesaid objectives an apparatus for block type extrusion coatings constructed according to the present invention comprises a die set and a control device, wherein the die set comprises an upper mold, a lower mold and a comb-shaped shim having a plurality of vacant regions, a first groove being formed on a lower surface of the upper mold, so that a plurality of channels for permitting a coating solution to flow from the first groove to a slit between a die lip of the upper mold to a die lip of the lower mold are formed between the upper mold and the lower mold, when the shim is disposed between the upper mold and the lower mold, wherein the upper mold further comprises a feed hole connected to the first groove, a first extraction hole connected to the first groove, and a second extraction hole connected to the first groove; and the control device comprising a first pump, a second pump, a first valve, a second valve, a third valve, and a controller, wherein the first pump and the first valve are placed at a feed pipe connected to the feed hole; the second pump and the third valve are placed at an extraction pipe connected to the second extraction hole; the second valve is placed at a release pipe connected to the first extraction hole; the first pump, the second pump, the first valve, the second valve, and the third valve being all electrically connected to the controller, so that the first pump, the second pump, the first valve, the second valve, and the third valve are capable of being controlled by a signal received from the controller.

Preferably, the controller controls the first pump, the second pump, the first valve, the second valve, and the third valve to be on/off or opened/closed according to following method: at a time t0, turning on the first pump and opening the first valve, and simultaneously closing the second valve and the third valve; at a time t1, simultaneously closing the first valve, and opening the second valve and the third valve, and turning on the second pump; and at a time t2, closing the third valve.

Preferably, the lower mold has a second groove corresponding to the first groove. More preferably, the lower mold has a second groove corresponding to the first groove.

Preferably, the shim has a thickness between 30-200 μm.

The present invention also discloses a process for forming block coatings by using the apparatus of the present invention, the process comprising:

introducing a coating solution from the feed hole to the die set, the coating solution flowing into the first groove, passing the plurality of channels and flowing from a slit between the die lip of the upper mold and the die lip of the lower mold out of the die set; and passing a substrate continuously below the slit of the die set, so that the coating solution is coated on a surface of the substrate; wherein the first pump, the second pump, the first valve, the second valve, and the third valve are controlled according to following method: at a time t0, simultaneously turning on the first pump and opening the first valve, and closing the second valve and the third valve; at a time t1, simultaneously closing the first valve, and opening the second valve and the third valve, and turning on the second pump; at a time t2, closing the third valve; and at a time t3 repeating the operation from time t0 to t3.

Preferably, the process of the present invention further comprises drying the coating solution coated on the substrate to obtain a product with an intermittently stripe coating or a block coating. More preferably, the process of the present invention further comprises performing a stripe coating process upon the product with an intermittently stripe coating or a block coating, and drying the stripe coating solution on the product to obtain a grid-type coated product.

Preferably, the first pump and the second pump are screw pumps, and the first pump and the second pump are controlled according to following method: at a time t0, turning on the first pump until a coating process is finished; and at a time t1, turning on the second pump until the coating process is finished.

The present invention utilizes an automatic programmed process and a die set to overcome the problems previously described. The block coating provided by the present invention has smooth and even front and rear edges, high repeatability, and a fast coating velocity.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
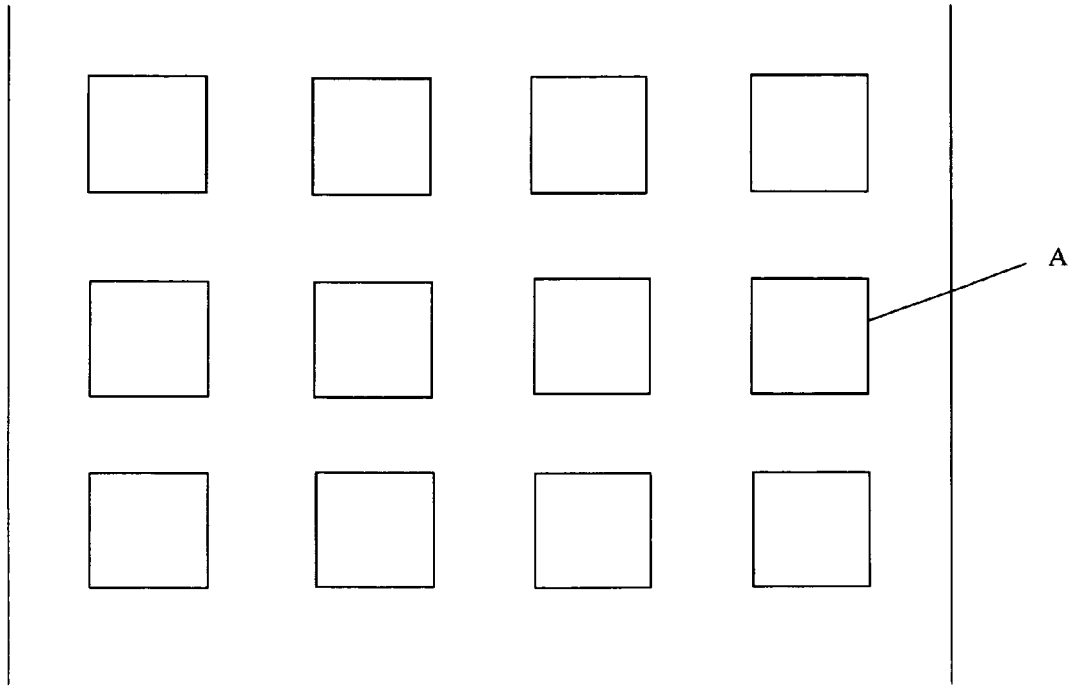
FIG. 1 is a schematic drawing of a block coating process according to the present invention.
Figure 2:
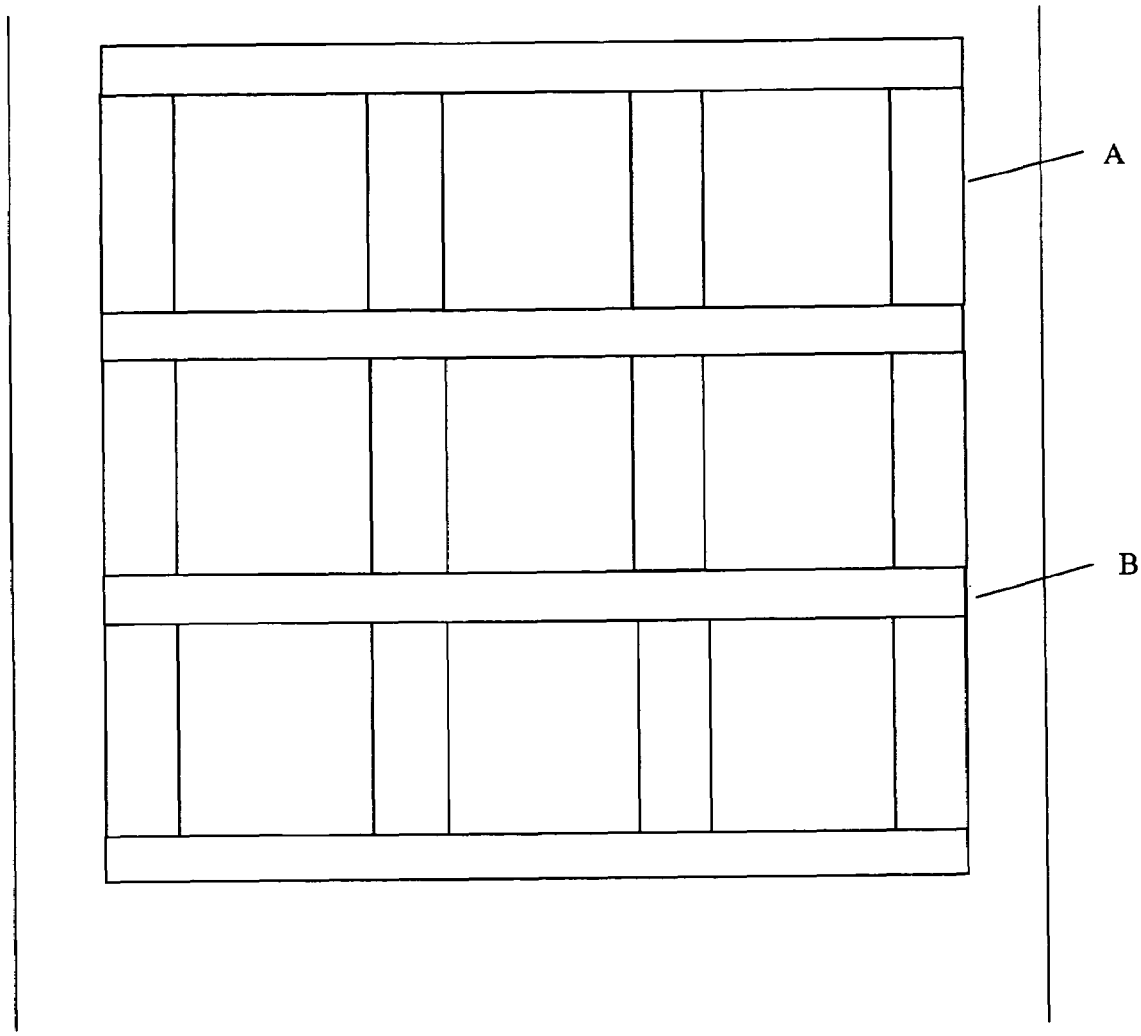
FIG. 2 is another schematic drawing of the block coating process according to the present invention.

According to a preferred embodiment of the present invention, stripe coating technology and block coating technology are combined to form a grid-type coating technology. The embodiment utilizes an automatic block coating apparatus composed of two pumps, three valves, one electronic controller and one die set to coat a plurality of even intermittent stripe coatings or block coatings with smooth front and rear edges on a substrate at one time, as shown by A in FIG. 1 and FIG. 2. After drying the substrate coated with the intermittent stripe coating, a stripe coating B is performed again to obtain the grid-type coating, as shown in FIG. 2.

The automatic block coating apparatus is shown in FIG. 3 to FIG. 6. The die set comprises an upper mold 6, a lower mold 6', and a shim 4.

Figure 3:
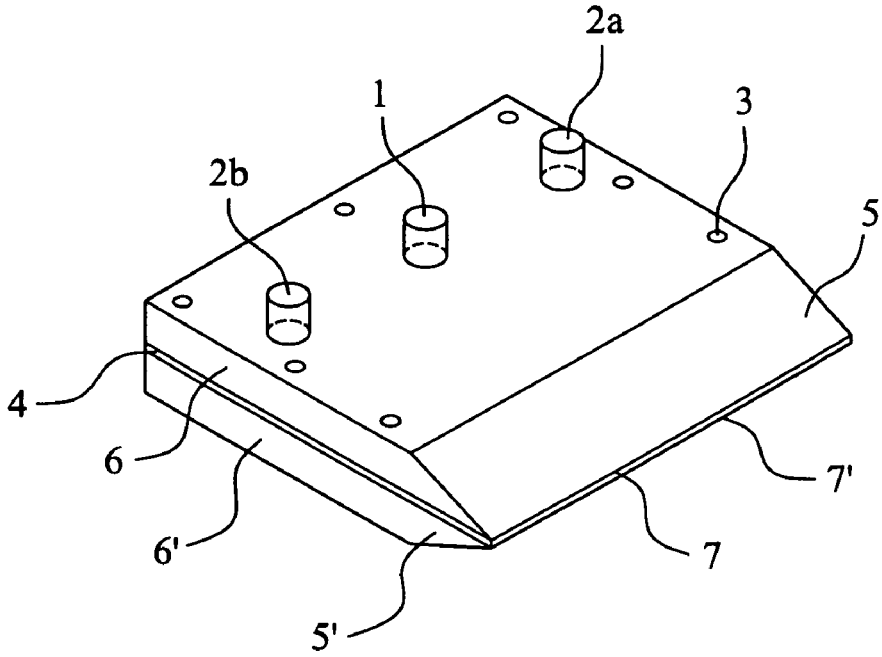
FIG. 3 is a perspective drawing of a die set according to the present invention.
Figure 4:
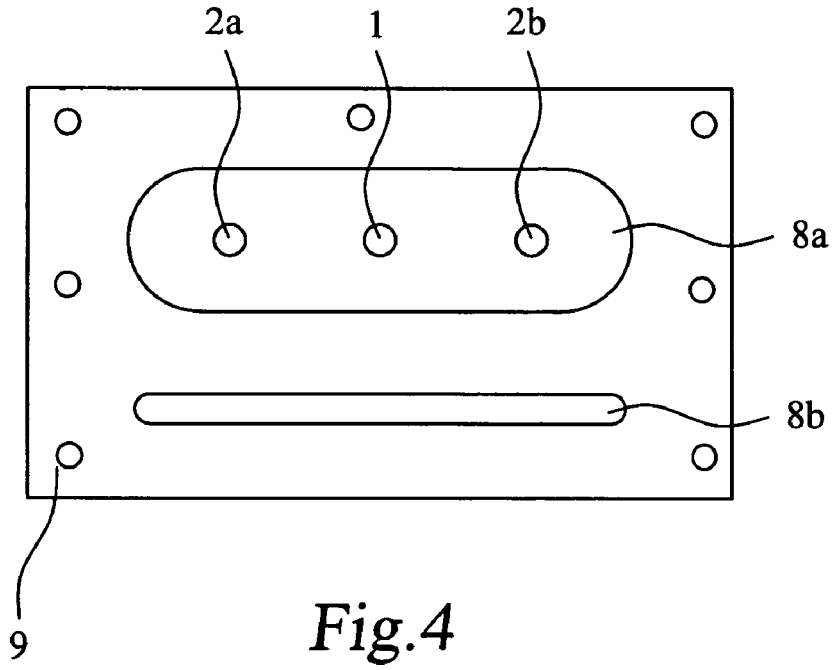
FIG. 4 is a bottom plan view of an upper mold of the die set shown in FIG. 3.

The upper mold 6, as shown in FIG. 3 and FIG. 4, comprises a feed hole 1, a first extraction hole 2*a*, a second extraction hole 2*b*, and a plurality of screw holes 3 on an upper surface of the upper mold; a first groove 8*a* and a second groove 8*b* on a lower surface of the upper mold; a die shoulder 5 of the upper mold formed by a slant surface on a side of the upper mold; and a die lip 7 of the upper mold 6 located at a common edge separating the die shoulder 5 and the lower surface thereof. The lower mold 6' and the upper mold 6 have a corresponding horizontal symmetric structure, but the lower mold 6' does not have the feed hole 1, the first extraction hole 2*a* or the second extraction hole 2*b*. Similar elements of the lower mold 6' and the upper mold 6 are designated with the same numerals, but are distinguished with a prime (') symbol. The feed hole 1, the first extraction hole 2*a* and the second extraction hole 2*b* are connected to the first groove 8*a*.

Figure 5:
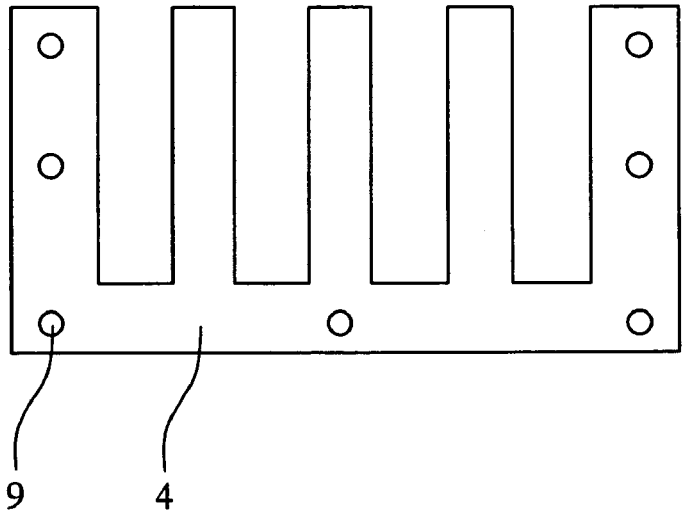
FIG. 5 is a plan view of a shim of the die set shown in FIG. 3.

The shim 4, as shown in FIG. 5, has a comb-shaped structure, and screw holes 9 corresponding to the lower mold, so that the upper mold 6, the shim 4 and the lower mold 6' can be screwed together. Four vacant regions in the structure of the shim 4 provide four channels for the coating solution to flow from the first groove 8*a* to a slit between the die lip 5 of the upper mold and the die lip 5' of the lower mold. Therefore, the coating solution can be introduced from the feed hole 1 shown in FIG. 3 to the die set; after filling the first groove 8*a*, the coating solution flows through the four channels into the slit between the die lip 5 of the upper mold and the die lip 5' of the lower mold to form four coated strips on a substrate when passing below the die set.

Figure 6:
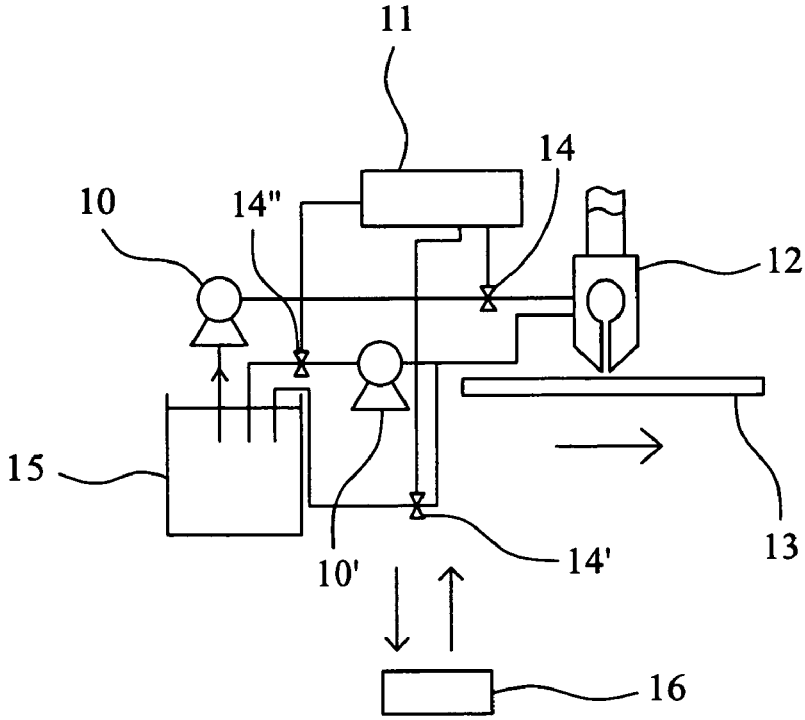
FIG. 6 is a schematic block drawing of a block coating apparatus according to the present invention.

As shown in FIG. 6, this embodiment utilizes an automatic control device composed of a first pump 10, a second pump 10', an electronic controller 11, a first valve 14, a second valve 14', and a third valve 14" to perform an intermittent coating process by passing through the die set 12. The first pump 10 and the first valve 14 are placed at a feed pipe connected to the feed hole 1. The second pump 10' and the third valve 14" are placed at an extraction pipe connected to the second extraction hole 2*b*. The second valve 14' is placed at a release pipe connected to the first extraction hole 2*a*. The first pump 10, the second pump 10', the first valve 14, the second valve 14', and the third valve 14" are controlled by signals received from the controller 10.

The coating solution is introduced from a coating solution tank 15 to the die set 12 via the first valve 14. When the electronic controller 11 is switched on to turn on the first pump 10 and open the first valve 14, and close the second valve 14', the third valve 14" and turn off the second pump 10' at the same time for a time period (0 to t1). At a predetermined time t1, the first valve 14 needs to be closed, and the second valve 14', the third valve 14" and the second pump 10' need to be opened and turned on at the same time. Next, at a predetermined time t2, the third valve 14" and the second pump 10' need to be closed and turned off; then, at a predetermined time t3, the operations during the time intervals from 0 to t3 are repeated to obtain an intermittent stripe or block coating. During the time interval from 0 to t1, the substrate is coated; during the time interval from t1 to t2, the coating process is stopped, and the third valve 14" is used for extracting the coating solution at the coating gap (a gap between the die lips of the die set and the substrate) of the coating, and the second valve 14' is to reduce the inertial force in the die set and the pipes. During the time interval from t2 to t3, the coating process is also stopped, and the third valve 14" is closed to prevent the coating solution in the die set from being extracted. During the time t1 to t3, the coating solution passes through the second valve 14' and the third valve 14" to return to the coating solution tank 15. The substrate with an intermittent stripe or block coating is sent into a baking oven 16 for drying, completing the intermittently stripe or block-coated product.

In order to obtain a grid-type coated product, a user can just turn the previous intermittently stripe coated product 90 degrees, and use the die set 12 to perform a stripe coating process, which includes: switching on the electronic controller 11 to turn on the first pump 10 and open the first valve 14, while simultaneously closing the second valve 14', the third valve 14" and turning off the second pump 10'. The coating solution thus enters into the die set 12 from the coating solution tank 15 via the first pump 10 and the first valve 14 to coat stripes onto the intervals between the spaced stripes on the intermittently stripe coated product, and then the baking oven 16 dries the coating to obtain a grid-type coated product.

EMBODIMENT

This embodiment was carried out by utilizing the apparatus shown in FIG. 3 to FIG. 6 to perform a coating experiment on a PET substrate. The substrate is A4 sized. The die set has following detailed dimensions:

the width of the die is 100 mm;
the first groove has a radius, R=10 mm;
the second groove has a radius, R=3 mm;
the thickness of the die lip is 0.2 mm; and
there are four channels with a width 1.125 cm.

The first pump 10 and the second pump 10" are two screw pumps made by HEISHIN Ltd. (Japan); the model type of the first pump 10 is 3NE06H, and the model type of the second pump 10' is 3NEL08.

The coating solution used in the experiments comprises:

PVA (polyvinyl alcohol)
Manufacturer: Chang Chun Corp. (Taiwan)
Model type: BP-2420, industry level
Concentration, wt %: 20%
Hydrolysis (mole %): about 86~89%
Molecular weight: 120,000

$TiO_2$ (with organic modified surface)
Manufacturer: Du Pont (US)
Code: R700
Average particle size: 0.34 μm
Specific gravity: 4.0

Conditions of the Experiment:

Test 1: PVA solution with 1% $TiO_2$, having a viscosity of 163 cps, a surface tension of 42 dyne/cm; a coating velocity of 3 cm/s; a coating solution flow rate of 0.20 mL/s; a coating gap (the distance between the die lip to the substrate) of 0.1 mm; and a 0.1 mm slit between the die lips of the lower mold and upper mold, which also indicate a shim thickness of 0.1 mm.

Test 2: PVA solution with 1% $TiO_2$, a viscosity of 163 cps, a surface tension of 42 dyne/cm; a coating velocity of 3 cm/s; a coating solution flow rate of 0.20 mL/s; a coating gap of 0.3 mm; and a 0.1 mm slit between the die lips of the lower mold and lower mold.

Test 3: PVA solution with 1% $TiO_2$, a viscosity of 63 cps, a surface tension of 45 dyne/cm; a coating velocity of 3 cm/s; a coating solution flow rate of 0.21 mL/s; a coating gap of 0.1 mm; and a 0.1 mm slit between the die lips of the lower mold and the upper mold.

Test 4: PVA solution with 1% $TiO_2$, a viscosity of 63 cps, a surface tension of 45 dyne/cm; a coating velocity of 3 cm/s; a coating solution flow rate of 0.21 mL/s; a coating gap 0.1 mm; and a 0.3 mm slit between the die lips of the lower mold and upper molde.

Test 5: PVA solution, viscosity of 1.6 cps, a surface tension of 54 dyne/cm; a coating velocity of 3 cm/s; a coating solution flow rate of 0.21 mL/s; a coating gap of 0.1 mm; and a 0.1 mm slit between the die lips of the lower mold and upper molde.

An automatic control program of the embodiment is set to a block coating process, and the size of every block is 1.125×1.125 cm; the distance between two blocks is 1.125 cm. In this program, the setting of the pumps and valves for different times are shown in following table, in which "+" indicates on or open, and "–" indicates off or closed:

| Time (sec) | The first valve 14 | The second valve 14' | The third valve 14" | The first pump 10 | The second pump 10' |
|---|---|---|---|---|---|
| 0 | + | – | – | + | + |
| 0.3 (t1) | – | + | + | + | + |
| 0.31 (t2) | – | + | – | + | + |
| 0.6 (t3) | + | – | – | + | + |
| . | . | . | . | . | . |
| . | . | . | . | . | . |
| . | . | . | . | . | . |

Since the first pump 10 and the second pump 10' were screw pumps, they were both kept on so as to be filled with the coating solution, and thus avoided pulse effects. If the present invention utilizes piston pumps, the first pump 10 and the first valve 14 would be controlled synchronously; and the second pump 10' and the third valve 14" would be controlled synchronously.

In the results, test 1 and test 3 obtain very good block coatings, but tests 2 and 4 do not obtain very good block coatings. Test 5 obtains good block coatings, but before being sent into the baking oven, the coated film begins to shrink, which is due to the low viscosity and high surface tension.

The only difference between test 1 and 2 is the coating gap; however, only test 1 obtains good block coatings. This may be because with larger coating gap, the minimum quantity for forming a film and the pressure difference for extruding would also change so that satisfactory block coatings are impossible.

The only difference between test 3 and 4 is the slit between the die lips of the lower mold and the upper mold; however, only test 3 obtains good block coatings. One reason for this may be that with a larger slit between the die lips, the minimum quantity for forming a film and the pressure difference for extruding also change so that satisfactory block coatings are impossible.

After placing the block coated substrate from test 1 and test 3 in a baking oven at 70° C. for a period of time (less than 30 sec), the substrate was turned 90 degrees while the second valve 14' and the third valve 14" and the second pump 10' were all turned off, and an stripe coating process can be performed again to obtain a grid-type coated product.

Although the present invention has been explained in relation to its preferred embodiment, it is to be understood that many other possible modifications and variations can be made without departing from the spirit and scope of the invention as hereinafter claimed.

What is claimed is:

1. An apparatus for block type extrusion coatings comprising a die set and a control device, wherein the die set comprises an upper mold, a lower mold and a comb-shaped shim having a plurality of vacant regions, a first groove being formed on a lower surface of the upper mold, so that a plurality of channels for permitting a coating solution to flow from the first groove to a slit between a die lip of the upper mold to a die lip of the lower mold are formed between the upper mold and the lower mold, when the shim is disposed between the upper mold and the lower mold, wherein the upper mold further comprises a feed hole connected to the first groove, a first extraction hole connected to the first groove, and a second extraction hole connected to the first groove; and the control device comprising a first pump, a second pump, a first valve, a second valve, a third valve, and a controller, wherein the first pump and the first valve are placed at a feed pipe connected to the feed hole; the second pump and the third valve are placed at an extraction pipe connected to the second extraction hole; the second valve is placed at a release pipe connected to the first extraction hole; the first pump, the second pump, the first valve, the second valve, and the third valve being all electrically connected to the controller, so that the first pump, the second pump, the first valve, the second valve, and the third valve are capable of being controlled by a signal received from the controller.

2. The apparatus as claimed in claim 1, wherein the controller controls the first pump, the second pump, the first valve, the second valve, and the third valve to be on/off or opened/closed according to following method: at a time t0, turning on the first pump and opening the first valve, and simultaneously closing the second valve and the third valve; at a time t1, simultaneously closing the first valve, and opening the second valve and the third valve, and turning on the second pump; and at a time t2, closing the third valve.

3. The apparatus as claimed in claim 2, wherein the lower mold has a second groove corresponding to the first groove.

4. The apparatus as claimed in claim 2, wherein the first pump and the second pump are screw pumps, and the first pump and the second pump are controlled according to following method: at a time t0, turning on the first pump until a coating process is finished; and at a time t1, turning on the second pump until the coatings are finished.

5. The apparatus as claimed in claim 1, wherein the lower mold has a second groove corresponding to the first groove.

6. The apparatus as claimed in claim 1, wherein the shim has a thickness between 30-200 μm.

* * * * *